US005176461A

United States Patent [19]

Kimura

[11] Patent Number: 5,176,461

[45] Date of Patent: Jan. 5, 1993

[54] LIQUID PAINTING INSTRUMENT WITH VALVE CONTROL

[75] Inventor: Masaru Kimura, Shinmachi, Japan

[73] Assignee: Mitsubishi Pencil Co., Ltd., Japan

[21] Appl. No.: 651,826

[22] Filed: Jan. 7, 1991

[51] Int. Cl.[5] ..... A46B 11/00; A46B 11/04

[52] U.S. Cl. ..... 401/279; 401/273; 401/278

[58] Field of Search ..... 401/273, 278, 279

[56] References Cited

U.S. PATENT DOCUMENTS 1,138,772 5/1915 Matthews ..... 401/273

2,746,073 5/1956 Harris ..... 401/278 X

FOREIGN PATENT DOCUMENTS 2202429 9/1988 United Kingdom ..... 401/273

*Primary Examiner*—Steven A. Bratlie

*Attorney, Agent, or Firm*—Armstrong, Nikaido, Marmelstein, Kubovcik & Murray

[57] ABSTRACT

A liquid painting instrument according to the present invention includes a neck portion of a cross-sectionally noncircular configuration provided on a wall having a passage hole that allows the neck member of the inner shaft to pass therethrough at a certain position in a circumferential phase while preventing the neck member from passing therethrough at other positions in the circumferential phase. The control wall is located at a position in front of the neck portion in the unknocked state. Projections are also provided on the front face of the neck member; each has a cam face that slides on the rear face of the control wall so as to displace the inner shaft rearward with respect to the fixed position where the valve is closed when the inner shaft is rotated preventing the neck member from passing through the passage hole.

4 Claims, 4 Drawing Sheets

LIQUID PAINTING INSTRUMENT WITH VALVE CONTROL

BACKGROUND OF THE INVENTION

1. Field of the Invention

The present invention relates to a liquid painting instrument for applying a liquid such as a hair dye.

2. Prior Art

Conventional hair coloring instruments such as those as shown in FIGS. 8 and 9, include an outer shaft 1, an inner shaft 1 which contains a hair dye therein and is axially movable in the outer shaft, a brush 3 fixed on the front end of the outer shaft 2, and a valve 4 interposed between the inner shaft 1 and the brush 3. The valve 4 is arranged to be opened so that the hair dye may be supplied from the inner shaft 1 to the brush 3 when the inner shaft 1 is advanced with respect to the outer shaft 2 by pushing forward a knocking member 5 arranged rearward of the inner shaft 1.

In such liquid painting instruments, to prevent the liquid from undesirably discharging from the inner shaft 1 with the knocking member 5 knocked forward (for example, when the instrument is dropped), measures such as that shown in the above drawings, include a projection 7 provided on the inner face of the opening of a tail plug 6 inlayed in the rear end of the outer shaft 2, and both a vertical groove 8 of axial direction and a lateral groove 9 of circumferential direction provided on the outer periphery of the knocking member 5 to receive the projection 7. The projection 7 may be located in the vertical groove 8 to allow knocking motion when the instrument is used. When not used, the projection 7 may be located in the lateral groove 9 to disable the knocking with the knocking member 5 rotated.

However, such known instruments still experience the undesired liquid discharge because the inner shaft 1 containing the liquid, as a result of its own weight, tends to be independently displaced by inertia (i.e., when dropped) without being pushed by the knocking member 5. Further, even if the inner shaft 1 can be prevented from such forward advancement by other means, there still exists the possibility of discharge due to dimensional dispersion in that the inner shaft can move forward a little. Therefore, completely preventing the undesirable discharge of the liquid is difficult.

In addition, formation of the vertical and lateral grooves 8, 9 on the outer periphery of the knocking member 5 involves impairs the good appearance of the instrument and thus is not desirable from a design viewpoint.

Accordingly, the present invention is aimed at providing a liquid painting instrument, without impairing its good appearance, that is capable of preventing the liquid from being undesirably discharged even if the inner shaft 1 is advanced by inertia due to its own weight. The present invention is also capable of completely preventing the liquid from being discharged even when there still exists some possibility for the inner shaft 1 to be advanced a little due to dimensional dispersion.

SUMMARY OF THE INVENTION

An object of the present invention is to provide a liquid painting instrument which incorporates:

a neck portion of cross-sectionally non-circular configuration provided on a portion near to the front end of the inner shaft;

a control wall having a passage hole that allows the neck member of the inner shaft to pass therethrough at a certain position in circumferential phase while disabling the neck member from passing therethrough at other positions in the circumferential phase, said control wall being located at a position in front of the neck portion in the unknocked state; and projections provided on the front face of the neck member, each having a cam face that slides on the rear face of the control wall to displace the inner shaft rearward with respect to the fixed position where the valve is closed when the inner shaft is rotated so as to prevent the neck member from passing through the passage hole.

BRIEF DESCRIPTION OF THE DRAWINGS

In the accompanying drawings, FIGS. 1-7 illustrate an embodiment of the present invention, wherein:

FIG. 1 is a general vertical sectional view;

FIG. 2 shows a vertical sectional view of a main part of the present invention, illustrated where the inner shaft and the stopper are engaged to prevent the neck portion of the inner shaft from passing through the passage hole;

FIG. 3 is a cross-sectional view taken along line C—C in FIG. 2;

FIG. 4 shows a vertical sectional view of the main part illustrated where the inner shaft and the stopper are engaged so that the neck member of the inner shaft may pass through the passage hole;

FIG. 5 is a cross-sectional view taken along line D—D in FIG. 4;

FIG. 6 is a perspective view of the collar on the inner shaft;

FIG. 7 is a cross-sectional view taken along line A—A in FIG. 1;

DETAILED DESCRIPTION AND THE PREFERRED EMBODIMENT

The present invention will be more fully understood from the following description of a preferred embodiment which is illustrated in FIGS. 1-7.

Figure 1:
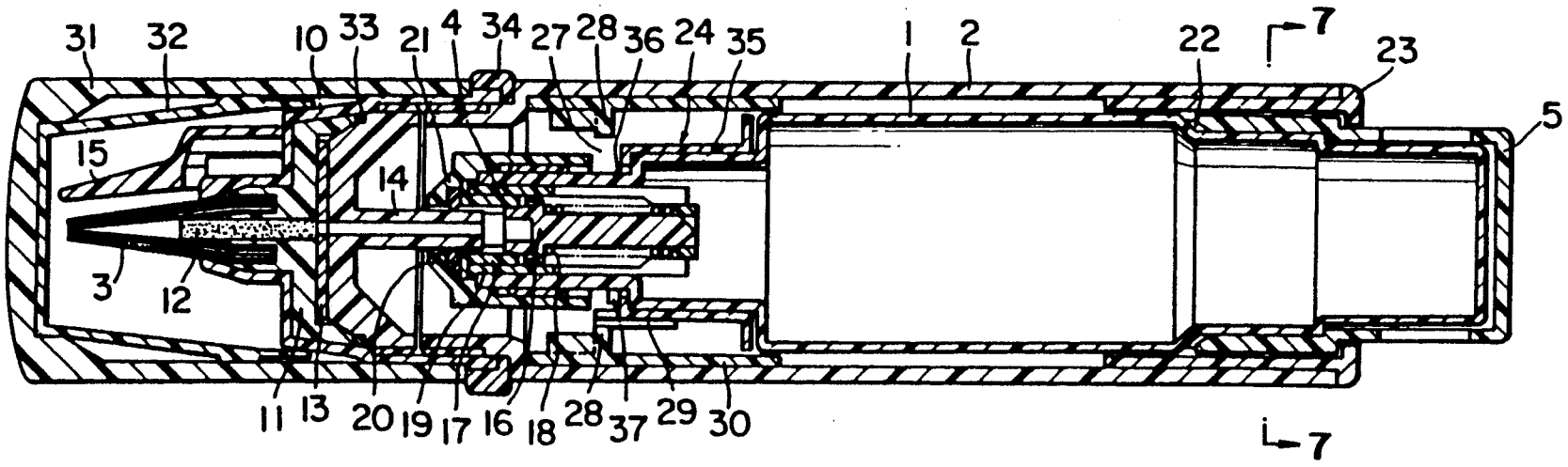
Figure 2:
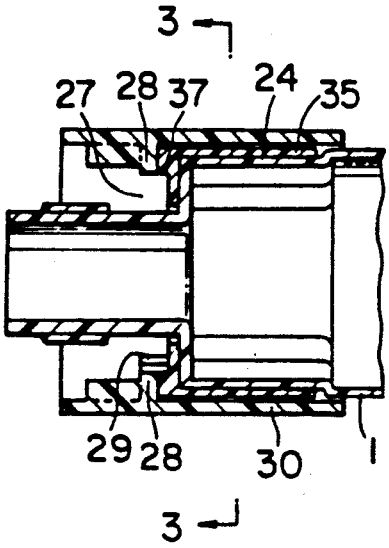

Referring now to FIG. 1, the outer shaft 2 is fastened by screwing its front end into the front shaft 10. In the front shaft 10 is fixedly inserted a pedestal 11 which holds an implanted brush 3. In a central hole of the pedestal 10 is inserted a sponge 12 which contacts the brush 3. To the back of the pedestal 11 is fixed a liquid guide pipe 14 through a sponge carrier 13, and on an outer side of the front end of the front shaft 10 is put a comb 15.

Figure 3:
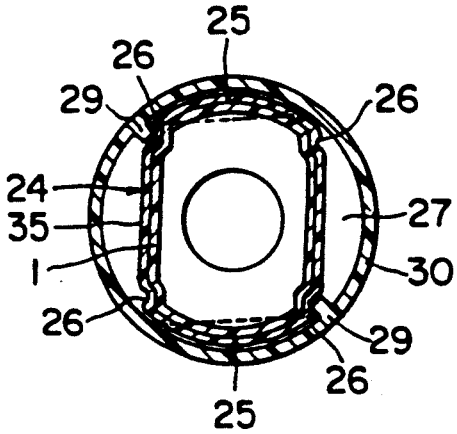
Figure 4:
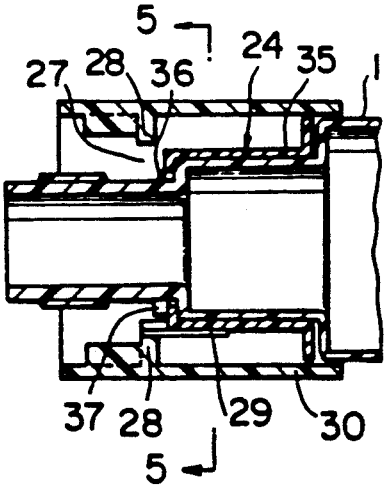
Figure 5:
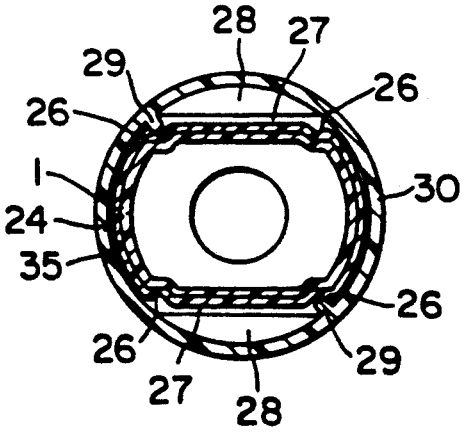
Figure 6:
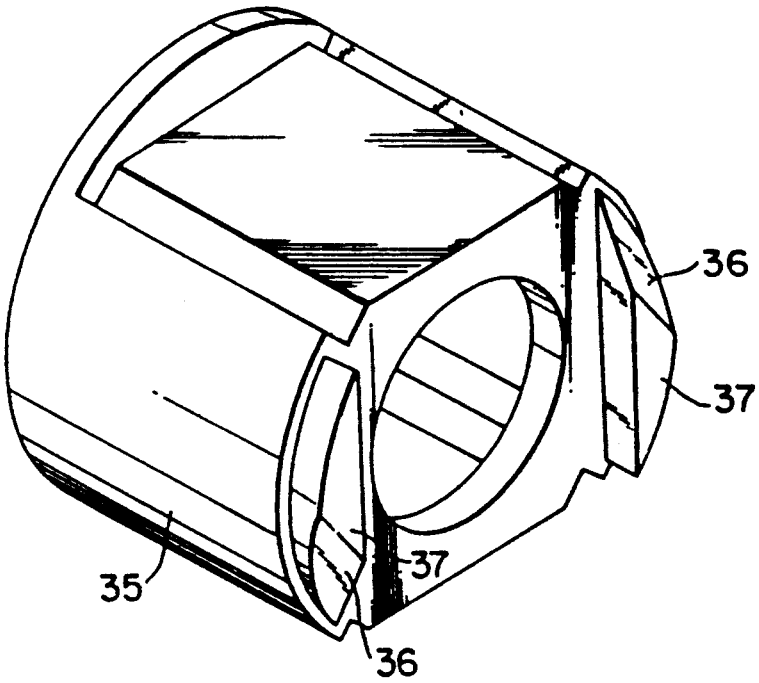
Figure 7:
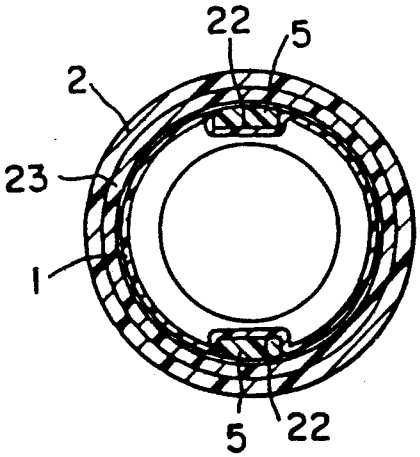
Figure 9:
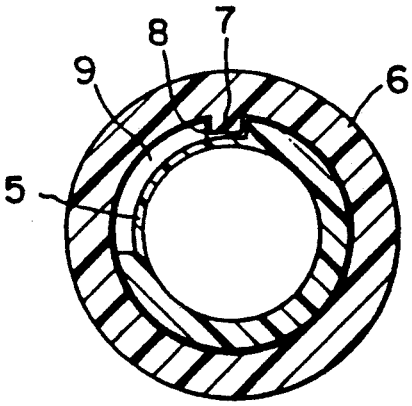
FIG. 9 PRIOR ART
FIG. 9 is a cross-sectional view taken along line B—B in FIG. 8.
Figure 8:
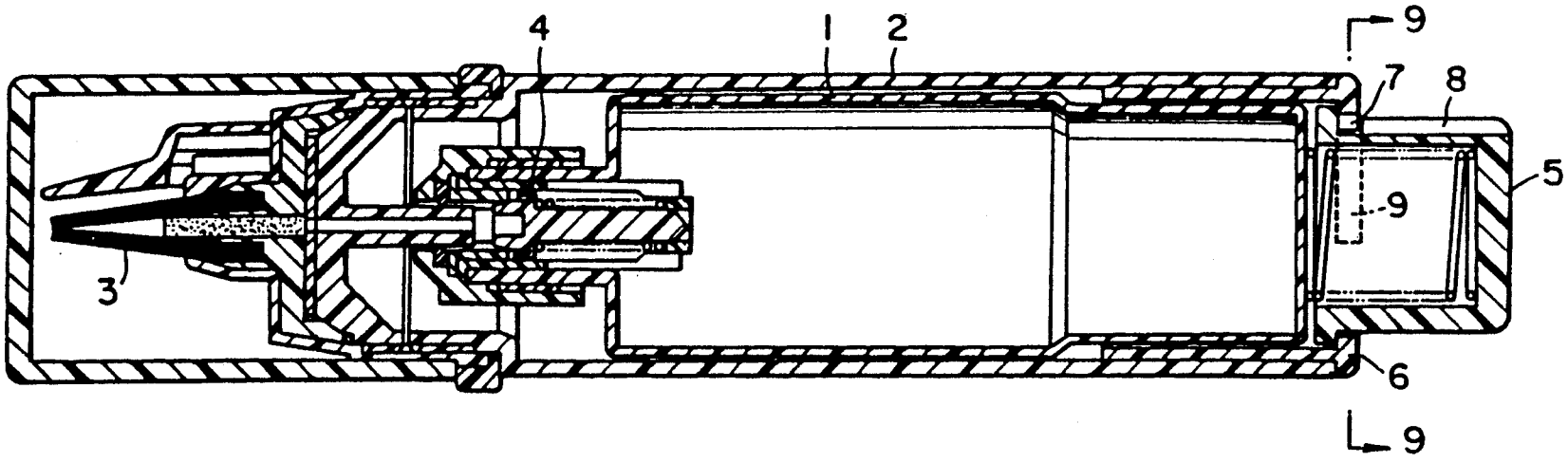
FIG. 8 PRIOR ART
FIG. 8 is a general view of a prior art.

Inside the outer shaft 2, the inner shaft 1 is positioned to be axially movable and is charged with a liquid hair dye (not shown). The inner shaft 1 is provided at its front end opening with the valve 4. Said valve 4 incorporates a valve rod 16, a valve seat 17 a valve spring 18 and a spring shoe 19. On the front end peripheral portion of the inner shaft 1 is fastened a cover member 21 which fixedly holds a packing 20 therein. In the central hole of the cover member 21 is inserted the rear end of the liquid guide pipe 14 positioned so as to provide a liquid-tight contact with the packing 20. The rear end of the liquid guide pipe 14 abuts against the front end of the valve rod 16. On the rear end peripheral portion of the inner shaft 1 is put a knocking member 5 such that, with axial grooves 22 on the inner shaft 1 engaged with projections on the knocking member 5, the inner shaft 1 may be integrally rotated by rotating the knocking member 5. Further, in the rear end opening of the outer shaft 2 is fixedly inserted a tail plug 23 which prevents the inner shaft 1 from slipping out rearwards. A neck portion 24 is located at a portion slightly rearward of the cover member 21 and on the front end of the inner shaft that is substantially oval-shaped in cross-section and both of whose sides faces are shaped flat. The neck portion 24 is arranged so that an inner shaft collar 35 as shown in FIG. 6 is fixedly put on a peripheral portion of the inner shaft 1 so as to be integrally rotated with the inner shaft 1. On both sides of the front end of the inner shaft collar 35 are formed two projections 37 each being about 1 mm high and having a cam face 36. As shown in FIG. 3, both end portions of each curved portion 25 of the neck portion 24 are formed stepped portions 26. Though the neck portion 24 in this embodiment is constructed with an inner shaft collar 35, it is to be noted that the neck portion 24 can be part of the inner shaft 1. On the other hand, a stopper 40 is fixedly put into the outer shaft 2. The stopper 30 is projectingly provided on the inner face thereof with a control wall 38 having a passage hole 27 that is formed similar to but slightly larger than the cross-sectional configuration of the neck portion 24 of the inner shaft 1, as seen in FIG. 5. The stopper 30 projects on its inner face with axial ribs 29 which extend rearward from one end of the edge of the control wall 28. The stopper 30 is located such that the control wall 38 thereof is positioned in front of the neck portion 24 of the inner shaft 2 in an unknocked state. More particularly, the stopper 30 is arranged such that, when the inner shaft 1 is in the unknocked state and placed at a given position to close the valve 4, the position of the front face of the neck portion 24 of the inner shaft 1 may substantially coincide with that of the rear face of the control wall 28. In FIG. 1, the reference number 31 denotes a cap, 33 a rear ring and 34 a decoration ring.

In operation, with the knocking member 5 integrally rotated together with the inner shaft 1 so that the configuration of the neck portion 24 of the inner shaft 1 may enter that of the passage hole 27 as shown in FIG. 5. If the knocking member 5 is pushed forward, then the neck portion 24 of the inner shaft is advanced through the passage hole 27, and the valve 4 is opened to supply the liquid hair dye discharged from the inner shaft 1 through the liquid guide pipe 14 and the sponge 12 to the brush 3. Since valve rod 16 per se abutted against the liquid guide pipe 14 cannot advance, it is consequently forced to move back relative the valve seat 17. It should be noted here that the stepped portions 26 and the ribs 29 are located such that, when the stepped portions 26 engage with the latters 29, the configuration of the neck portion 24 my be just received in the passage hole 27.

Next, when the neck portion 24 is positioned rearward of the passage hole 27 and the inner shaft 1 is rotated to reverse direction, with knocking member 5 released from pressure and the inner shaft 1 moved back by the restoring force of the valve spring 18, the configuration of the neck portion 24 deviates from that of the passage hole 27 as shown by dotted line in FIG. 3. Accordingly, the inner shaft 1 can no longer be advanced even if inertia is created due to its own weight, since the control wall 28 now prevents such advancement. Thus, if brought to such a condition during non-use of the instrument, then undesirable discharge of the liquid hair dye due to the advancement of the inner shaft 1 can be prevented. Also in this case, the other stepped portions 26 are conveniently arranged to engage with the ribs 29, as shown in FIG. 3. Further, when the inner shaft is rotated, the sloped cam face 36 formed on the front face of the neck portion 24 slides the rear face of the control wall 28 so that the inner shaft 1 may be moved back by the height of the projections 37. Accordingly, the inner shaft 1 when not used is further retracted from the fixed position required to close the valve 4. The amount of the retraction, or the height of said projection 37 (its length in the axial direction), is set larger than the distance of possible advancement of the inner shaft due to dimensional dispersion. Thus, the inner shaft 1 does not advance beyond the fixed position required to valve the valve 4 even if there exists some dimensional dispersion, and the liquid hair dye can be completely prevented when non-use from being discharged through the valve 4.

As described above, the liquid painting instrument according to the present invention includes the neck portion 24 of a cross-sectionally, non-circular shape formed on the inner shaft 1 and the control wall 28 provided in front of the position of the neck portion 24 in the unknocked state. Having the passage hole 27 that allows the neck portion 24 to pass therethrough at a fixed position in some circumferential phase while preventing the neck portion 24 from passing therethrough at positions other than the above. Thus, when the liquid painting instrument is not in use, any possible advancement of the inner shaft 1 by the inertia thereof due to its own weight is controlled thereby preventing the liquid from being undesirably discharged. Since the projections 37 with the sloped cam face 36 are provided on the front face of the neck portion 24 so that the inner shaft 1 may be moved back during non-use to a further retreated position than the fixed position required for closing the valve 4, the valve 4 can be prevented from being opened even if there exists some dimensional dispersion. The liquid is completely prevented from undesirable discharge. Moreover, since forming vertical and lateral grooves 8, 9 on the knocking member 5 as in the prior art is not longer required, such drawbacks of impairing the good appearance of the instrument can be avoided.

What is claimed is:

1. In a liquid painting instrument having an outer shaft, an inner shaft which contains a liquid therein and is engaged in the outer shaft to be axially movable, a painting member fixed on a front end of the outer shaft, and a valve interposed between the inner shaft and the painting member, the valve being openable so that the liquid may be supplied from the inner shaft to the painting member when the inner shaft is advanced with respect to the outer shaft, the inner shaft comprising:

a neck portion having a non-circular cross-section and provided on a portion near to the front end of the inner shaft;

a control wall having a passage hole that allows said neck portion of the inner shaft to pass therethrough at a certain position in a circumferential phase while preventing said neck portion from passing to other positions in the circumferential phase, said control wall being located at a position in front of said neck portion in an unknocked state; and a plurality of projections located on a face of said neck portion, each of said plurality of projections having a cam face that slidably contacts a rear face of said control wall so as to displace the inner shaft rearward with respect to a fixed position where the valve is closed when the inner shaft is rotated so as to prevent said neck portion from passing through the passage hole.

2. In a liquid painting instrument according to claim 1, wherein said neck portion includes an inner shaft collar fixed on the inner shaft.

3. A liquid painting instrument comprising:

an outer shaft;

a painting member connected to a front end of said outer shaft; and an inner shaft for containing a liquid therein, said inner shaft being axially and movably engaged in said outer shaft, further said inner shaft including a neck portion having a non-circular cross-section and provided on a portion near to the front end of the inner shaft, a control wall having a passage hole that allows the neck portion of said inner shaft to pass therethrough to a first position in a circumferential phase while preventing said neck portion from passing to other positions in the circumferential phase, the control wall being located in front of the neck portion in an unknocked state, and a plurality of projections located on a front face of the neck portion, each of the plurality of projections having a cam face that slidably contacts a rear face of the control wall so as to displace said inner shaft rearward relative to a fixed position where a valve connected between said inner shaft and said painting member is closed when said inner shaft is rotated so as to prevent said neck portion from passing through the passage hole;

and a valve connected between said inner shaft and said painting member, said valve being openable so that the liquid may be supplied from said inner shaft to said painting member when said inner shaft advances in position relative to said outer shaft.

4. A liquid painting instrument according to claim 3, wherein the neck portion of said inner shaft includes an inner shaft collar fixed on said inner shaft.

* * * * *